United States Patent [19]

Toyoda et al.

[11] 4,326,113

[45] Apr. 20, 1982

[54] HEATER DISPOSED BELOW A TURNTABLE IN A COMBINATION MICROWAVE AND ELECTRIC OVEN

[75] Inventors: Munemitsu Toyoda, Osaka; Koichiro Adachi, Nara, both of Japan

[73] Assignee: Sharp Kabushiki Kaisha, Osaka, Japan

[21] Appl. No.: 107,889

[22] Filed: Dec. 28, 1979

Related U.S. Application Data

[63] Continuation of Ser. No. 830,887, Sep. 6, 1977, abandoned.

[30] Foreign Application Priority Data

Sep. 6, 1976 [JP] Japan ..... 51-120467[U]

[51] Int. Cl.[3] ..... H05B 9/06

[52] U.S. Cl. ..... 219/10.55 D; 219/10.55 F; 219/10.55 R

[58] Field of Search ..... 219/10.55 R, 10.55 B, 219/10.55 D, 10.55 F, 10.55 M, 388, 389, 390, 392, 400, 406, 405; 99/DIG. 14, 423, 409; 126/200

[56] References Cited

U.S. PATENT DOCUMENTS

| | | | |
|---|---|---|---|
| 2,724,764 | 11/1955 | Ritchie | 219/392 X |
| 2,912,554 | 11/1959 | Snyder | 219/10.55 F |
| 3,177,334 | 4/1965 | Kinkle | 174/35 |
| 3,182,166 | 5/1965 | Bohm et al. | 99/423 |
| 3,744,403 | 7/1973 | Castronuovo | 219/389 |
| 3,767,883 | 10/1973 | Staats | 219/10.55 B |
| 4,036,151 | 7/1977 | Shin | 99/DIG. 14 |
| 4,092,512 | 5/1978 | Suzuki et al. | 219/10.55 F |
| 4,129,769 | 12/1978 | Takagi et al. | 219/10.55 B |

FOREIGN PATENT DOCUMENTS

| | | | |
|---|---|---|---|
| 1092484 | 11/1967 | United Kingdom | 219/10.55 F |

*Primary Examiner*—B. A. Reynolds
*Assistant Examiner*—M. H. Paschall
*Attorney, Agent, or Firm*—Birch, Stewart, Kolasch & Birch

[57] ABSTRACT

A sheath heater is disposed below a turntable in a combination microwave and electric oven to maintain an oven temperature at a predetermined value. The sheath heater is shaped in such a manner that a loop size surrounded by the sheath heater is greater than the turntable size. That is, the sheath heater substantially protrudes beyond the periphery of the turntable to enhance the heating efficiency of the oven.

23 Claims, 5 Drawing Figures

HEATER DISPOSED BELOW A TURNTABLE IN A COMBINATION MICROWAVE AND ELECTRIC OVEN

This application is a continuation of copending application Ser. No. 830,887, filed on Sept. 6, 1977, now abandoned.

BACKGROUND OF THE INVENTION

The present invention relates to a combination microwave and electric oven and, more particularly, to a heater arrangement disposed below a turntable employed within a combination microwave and electric oven.

A combination microwave and electric oven has been developed as disclosed in U.S. Pat. No. 3,172,987 entitled "COMBINATION ELECTRIC AND ELECTRONIC OVENS" on Mar. 9, 1965. A turntable is effective to perform a uniform microwave cooking, and a heater means is disposed below the turntable to maintain the oven temperature at a predetermined value in the electric heating mode.

In the conventional combination microwave and electric oven having a heater means disposed below the turntable, the heater means does not protrude from the periphery of the turntable. Therefore, the radiant heat generated from the heater means is substantially reflected by the turntable. This reduces the efficiency of the electric heating cooking. Moreover, a drive mechanism coupled to the turntable may be damaged by the heat energy maintained below the turntable.

OBJECTS AND SUMMARY OF THE INVENTION

Accordingly, an object of the present invention is to provide a combination microwave and electric oven including a heater disposed below a turntable.

Another object of the present invention is to enhance the electric heating efficiency in a combination microwave and electric oven including a heater disposed below a turntable.

Still another object of the present invention is to provide a novel heater arrangement which ensures stable operation of a combination microwave and electric oven.

Other objects and further scope of applicability of the present invention will become apparent form the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention a sheath heater disposed below a turntable is shaped in such a manner that a loop size surrounded by the sheath heater is greater than the turntable size. That is, the sheath heater protrudes substantially beyond the periphery of the turntable to enhance the heating efficiency when in the electric heating cooking mode.

Accordingly, the radiant heat generated from the sheath heater is effectively transferred to the oven cavity to heat the ambience surrounding a foodstuff mounted on the turntable. Moreover, the heat energy generated from the sheath heater will not damage the drive mechanism of the turntable when the drive mechanism is the central driven type.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
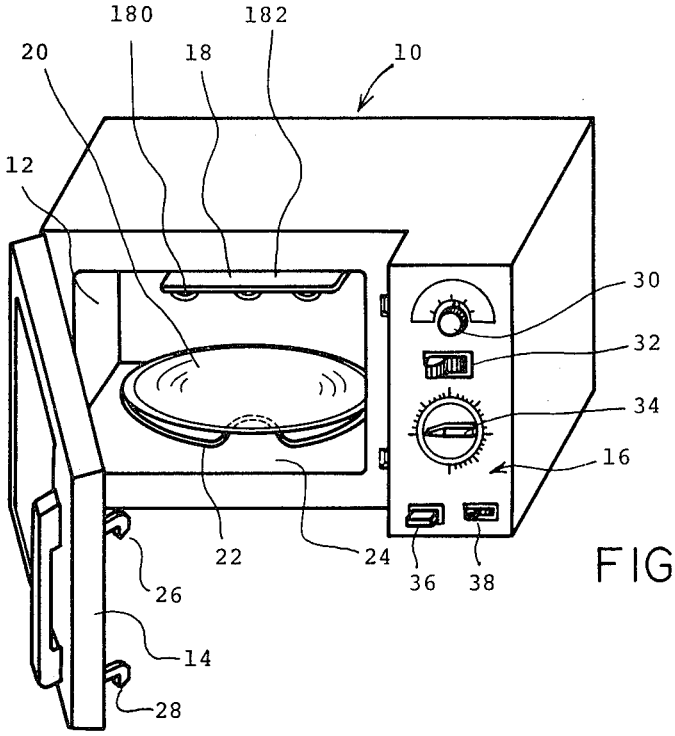
FIG. 1 is a perspective view of a combination microwave and electric oven including an embodiment of a heater means of the present invention.

FIG. 1 shows a combination microwave and electric oven including an embodiment of a heater means of the present invention.

A combination microwave and electric oven 10 mainly includes an oven cavity 12, an oven door 14 and a control panel 16. An upper heater 18 is disposed at the upper portion of the oven cavity 12, and a turntable 20 is disposed at the bottom portion of the oven cavity 12 for supporting a foodstuff mounted thereon. A bottom heater 22 is disposed between the turntable 20 and a bottom wall 24 of the oven cavity 12.

The upper heater 18 comprises a sheath heater 180 and a reflection plate 182. The upper heater 18 functions to brown the surface of the foodstuff mounted on the turntable 20. The turntable 20 is driven to rotate in both of the microwave cooking mode and the electric heating cooking mode. The bottom heater 22 is made of a sheath heater, and functions to heat up the oven temperature in the electric heating cooking mode.

The oven door 14 includes locking means 26 and 28. The control panel 16 includes a temperature setting knob 30 for setting the oven temperature in the electric heating cooking mode, a selection switch 32 for selectively performing the microwave cooking and the electric heating cooking, a timer setting knob 34 for determining a cooking period, a cook switch 36, and a control switch 38 for rotating the turntable 20.

Figure 2:
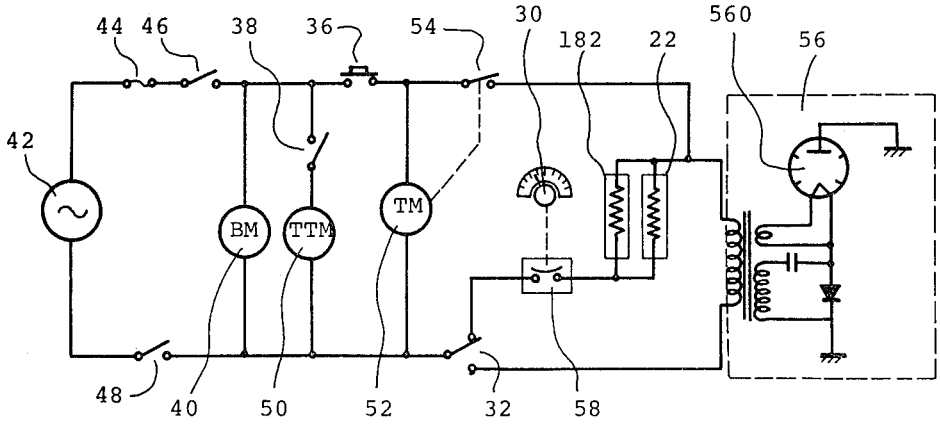
FIG. 2 is a circuit diagram of the combination microwave and electric oven of FIG. 1.

FIG. 2 shows a circuit construction of the combination microwave and electric oven of FIG. 1. Like elements corresponding to those of FIG. 1 are indicated by like numerals.

A blower motor 40 is power supplied by an A.C. power source 42 through a fuse 44 and first and second interlock switches 46 and 48 associated with the locking means 26 and 28, respectively. A turntable motor 50 is power supplied when the control switch 38 is closed to rotate the turntable 20. A timer motor 52 is power supplied when the cook switch 36 is closed, whereby a timer contact 54 is closed during a time period determined by the timer setting knob 34.

A microwave generation circuit 56 including a magnetron 560 is energized when the selection switch 32 is placed in the microwave cooking mode. The energization period is determined by the timer setting knob 34. The upper sheath heater 182 and the bottom sheath heater 22 are power supplied when the selection switch 32 is placed in the electric heating mode. The temperature setting knob 30 is associated with a thermostat 58, thereby controlling the power supply to the upper and bottom sheath heaters 182 and 22. Accordingly, the oven temperature is maintained at a predetermined value determined by the temperature setting knob 30 for a time period determined by the timer setting knob 34.

Figure 3:
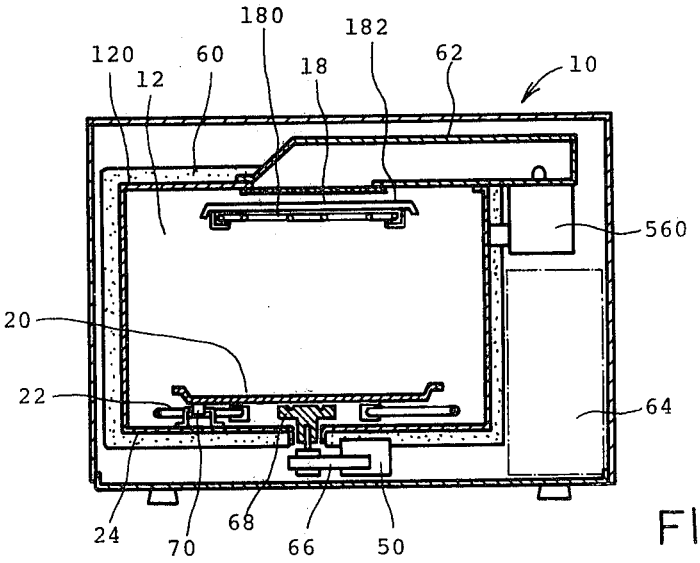
FIG. 3 is a sectional view of the combination microwave and electric oven of FIG. 1.

FIG. 3 is a sectional view of the combination microwave and electric oven of FIG. 1. Like elements corresponding to those of FIGS. 1 and 2 are indicated by like numerals.

The oven cavity 12 is determined by metal walls 120 and 24. Heat insulating walls or athermanous walls 60 made of, for example, glass wool, asbestos or calcium silicate are provided in such a manner as to surround the oven walls 120 and 24, whereby the oven cavity 12 is maintained at a high temperature when the electric heating cooking is performed. The microwave energy generated from the magnetron 560 is introduced into the oven cavity 12 through a waveguide 62 for performing the microwave cooking. A power supply unit 64 is disposed outside the oven cavity 12.

The turntable 20 is driven to rotate by the turntable motor 50 through a drive mechanism 66 and a coupler 68. The turntable 20 is driven to rotate at the center thereof, and supporting rollers 70 are provided at desired positions to ensure the stable rotation of the turntable 20. The coupler 68 is preferably made of heat-resisting plastics. The turntable 20 should be the central driven type to protect the drive mechanism 66 and the coupler 68 from the heat energy generated from the bottom sheath heater 22. The turntable 20 is made of ceramics, heat-resisting glass or a metal coated with enamel.

Figure 4:
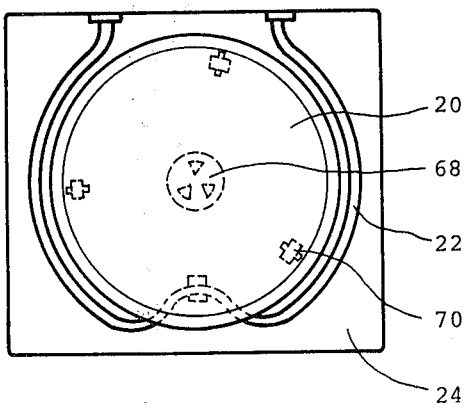
FIG. 4 is a plan view showing an example of a heater arrangement included within the combination microwave and electric oven of FIG. 1.
Figure 5:
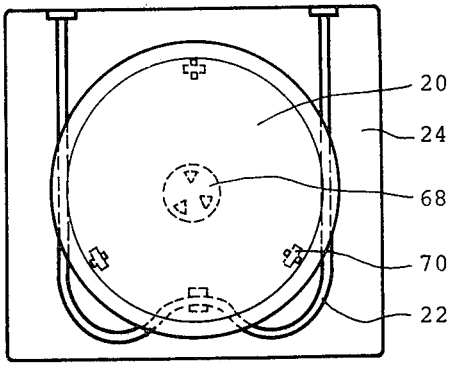
FIG. 5 is a plan view showing another example of a heater arrangement included within the combination microwave and electric oven of FIG. 1.

FIGS. 4 and 5 show examples of arrangement of the bottom sheath heater 22. Like elements corresponding to those of FIG. 3 are indicated by like numerals.

The bottom sheath heater 22 is shaped in such a manner that a loop size surrounded by the bottom sheath heater 22 is greater than the size of the turntable 20. That is, the bottom sheath heater 22 protrudes to a substantial extent from the periphery of the turntable 20 to enhance the heating efficiency in the electric heating cooking mode.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a combination microwave and electric oven energized by a power source and capable of operating in an electric heating mode and a microwave cooking mode, said combination microwave and electric oven including an oven cavity, a microwave generating means operatively associated with said oven cavity for generating microwave energy during said microwave cooking mode, a heating means disposed in said oven cavity for generating electric heat energy during said electric heating mode, and a turntable having a solid plate construction disposed at the lower section of said oven cavity for mounting a foodstuff thereon, at least the top surface of said turntable being a continuous surface devoid of any holes therethrough, said heating means further comprising:

an upper heating means disposed at a top wall of said oven cavity for emitting said electric heat energy; and a lower heating means disposed between said turntable a bottom wall of said oven cavity for emitting said electric heat energy, a substantial portion of said lower heating means extending beyond the peripheral surface of said turntable thereby forcing substantially the entire amount of said electric heat energy being emitted from said lower heating means to pass around the peripheral surface of said turntable and thereby heating the environment within said oven cavity above said turntable, a negligible amount of said electric heat energy from said lower heating means passing through said turntable, said foodstuff being cooked during said electric heating mode solely by said electric heat energy disposed within the environment of the oven cavity above said turntable.

2. The combination microwave and electric oven of claim 1, wherein the lower heating means is a sheath heater.

3. The combination microwave and electric oven of claim 1, wherein said turntable is rotated by a central driving means, said central driving means being positioned within said oven cavity to avoid said electric heat energy emitted from said lower heating means.

4. The combination microwave and electric oven of claim 3, wherein the turntable is a metal plate coated with enamel.

5. The combination microwave and electric oven of claim 3, wherein the turntable is rotated by said central driving means when operating in both the microwave cooking mode and the electric cooking mode.

6. The combination microwave and electric oven of claim 1, wherein said upper heating means and said lower heating means are simultaneously energized when operating in the electric heating mode.

7. The combination microwave and electric oven of claim 1, wherein said oven cavity is surrounded by heat insulating walls.

8. The combination microwave and electric oven of claim 3 wherein the turntable is made of ceramics.

9. The combination microwave and electric oven of claim 3 wherein the turntable is made of a heat-resistant glass.

10. The combination microwave and electric oven of claim 3 wherein said central driving means comprises:

turntable motor means for providing mechanical energy for rotating said turntable;

drive mechanism means responsive to the mechanical energy from said turntable motor means for providing a linkage mechanism for rotating said turntable in response to the mechanical energy provided by said turntable motor means; and coupler means for coupling said drive mechanism means to said turntable, said coupler means being made of a heat resistant plastic material.

11. The combination microwave and electric oven of claim 10 wherein said combination microwave and electric oven further comprises:

support roller means disposed between said turntable and said bottom wall of said oven cavity for supporting said turntable during rotation thereof, thereby ensuring stable rotation of said turntable.

12. The combination microwave and electric oven of claim 10 wherein said combination microwave and electric oven further comprises:

control switch means connected in series with said turntable motor means and mounted on a front panel of said oven for switching to a first switched condition thereby allowing said turntable motor means to rotate said turntable and for switching to a second switched condition thereby preventing said turntable motor means from rotating said turntable.

13. The combination microwave and electric oven of claim 12 wherein said combination microwave and electric oven further comprises:

cook switch means mounted on said front panel of said oven and responsive to power energy from said power source for initiating operation of said microwave and electric oven in response to actuation thereof; and timer means responsive to actuation of said cook switch and mounted on said front panel of said oven for selectively changing the amount of time for operating said oven in either said electric heating mode or said microwave cooking mode after actuation of said cook switch means.

14. The combination microwave and electric oven of claim 13 wherein said combination microwave and electric oven further comprises:

selector switch means mounted on said front panel of said oven for switching to a first switched position thereby permitting the energization of said heating means and for switching to a second switched position thereby permitting the energization of said microwave generating means.

15. The combination microwave and electric oven of claim 14 wherein said combination microwave and electric oven further comprises:

temperature setting means for selectively changing the temperature of said electric heat energy generated by said heating means; and thermostat means responsive to the setting on said temperature setting means and in series with said upper and lower heating means for changing the amount of electric current passing through said lower heating means and said upper heating means in accordance with the setting on said temperature setting means.

16. The combination microwave and electric oven of claim 15 wherein said combination microwave and electric oven further comprises:

timer contact means in series with said power source for switching to an ON condition thereby allowing the power energy from said power source to pass through to said heating means and said microwave generating means in response to energization of said timer means by actuation of said cook switch means.

17. The combination microwave and electric oven of claim 16 wherein said heating means is energized when said selector switch means is switched to said first switched position and when said cook switch means and said timer contact means is actuated to an ON condition.

18. The combination microwave and electric oven of claim 17 wherein said microwave generating means is energized when said selector switch means is switched to said second switched position and when said cook switch means and said timer contact means is actuated to said ON condition.

19. The combination microwave and electric oven of claim 18 wherein said combination microwave and electric oven further comprises:

support roller means disposed between said turntable and said bottom wall of said oven cavity for supporting said turntable during rotation thereof, thereby ensuring stable rotation of said turntable.

20. The combination microwave and electric oven of claim 19 wherein the lower heating means is a sheath heater.

21. The combination microwave and electric oven of claim 20 wherein the turntable is a metal plate coated with enamel.

22. The combination microwave and electric oven of claim 21 wherein the turntable is rotated by said central driving means when operating in both the microwave cooking mode and the electric cooking mode.

23. The combination microwave and electric oven of claim 22 wherein said oven cavity is surrounded by heat insulating walls.

* * * * *